US011491786B2

(12) United States Patent
Yamamoto et al.

(10) Patent No.: US 11,491,786 B2
(45) Date of Patent: Nov. 8, 2022

(54) LIQUID DISCHARGE HEAD

(71) Applicant: Brother Kogyo Kabushiki Kaisha, Nagoya (JP)

(72) Inventors: Jiro Yamamoto, Nagoya (JP); Keita Sugiura, Toyokawa (JP); Taisuke Mizuno, Yokkaichi (JP); Shotaro Kanzaki, Handa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/142,683

(22) Filed: Jan. 6, 2021

(65) Prior Publication Data

US 2021/0206169 A1 Jul. 8, 2021

(30) Foreign Application Priority Data

Jan. 6, 2020 (JP) ..... JP2020-000075

(51) Int. Cl.
*B41J 2/14* (2006.01)

(52) U.S. Cl.
CPC ..... *B41J 2/14274* (2013.01); *B41J 2/1433* (2013.01); *B41J 2002/14306* (2013.01); *B41J 2002/14419* (2013.01); *B41J 2202/11* (2013.01); *B41J 2202/12* (2013.01)

(58) Field of Classification Search
CPC ..... B41J 2/14274; B41J 2/1433; B41J 2002/14306; B41J 2002/14419; B41J 2202/11; B41J 2202/12; B41J 2/18
See application file for complete search history.

(56) References Cited

U.S. PATENT DOCUMENTS

| | | | | |
|---|---|---|---|---|
| 9,878,537 | B2 | 1/2018 | Murai et al. | |
| 9,908,339 | B2 * | 3/2018 | Irokawa | B41J 2/1433 |
| 10,399,336 | B2 | 9/2019 | Katakura et al. | |
| 2017/0096015 | A1 | 4/2017 | Odaka et al. | |
| 2017/0282557 | A1 | 10/2017 | Murai et al. | |
| 2018/0281411 | A1 | 10/2018 | Katakura et al. | |
| 2018/0281443 | A1 | 10/2018 | Sakai et al. | |

FOREIGN PATENT DOCUMENTS

| | | | |
|---|---|---|---|
| JP | 2017-065249 | A | 4/2017 |
| JP | 2017-185676 | A | 10/2017 |
| JP | 2018-165004 | A | 10/2018 |
| JP | 2018-165005 | A | 10/2018 |

* cited by examiner

*Primary Examiner* — Geoffrey S Mruk
(74) *Attorney, Agent, or Firm* — Banner & Witcoff, Ltd.

(57) ABSTRACT

A liquid discharge head includes an individual channel which includes: a nozzle; a pressure chamber; a descender of which one end in the first direction is nearer to the nozzle than the other end; and a second connecting channel connecting a second common channel and the one end of the descender. A central axis of the nozzle is positioned between the second common channel and a central axis of the descender in the second direction. The descender includes a first portion including the one end and a second portion positioned between the pressure chamber and the first portion in the first direction. In an end, of the descender, opposite to the second connecting channel in the second direction, an inner wall defining the one end of the first portion protrudes toward the second connecting channel in the second direction beyond an inner wall defining the second portion.

17 Claims, 8 Drawing Sheets

LIQUID DISCHARGE HEAD

CROSS REFERENCE TO RELATED APPLICATION

The present application claims priority from Japanese Patent Application No. 2020-000075 filed on Jan. 6, 2020, the disclosure of which is incorporated herein by reference in its entirety.

BACKGROUND OF THE INVENTION

Field of the Invention

The present disclosure relates to a liquid discharge head configured to discharge liquid from nozzles.

Description of the Related Art

In the liquid discharge head described in Japanese Patent Application Laid-open No. 2017-65249 corresponding to United States Patent Application Publication No. US2017/0096015, an individual liquid chamber in which pressure is applied to the liquid by a piezoelectric actuator is connected to a common liquid chamber via a supply-channel-side fluid resistive portion. The individual liquid chamber and the nozzle are connected to each other via a nozzle path extending to an up-down direction. A horizontally extending circulation channel is connected to the nozzle path. The circulation channel is connected to a circulating common channel via a discharge passage. A center axis of the nozzle is positioned at the circulation channel side of a center axis of the nozzle path.

In the liquid discharge head in which the liquid flows from the common liquid chamber to the circulating common channel via the individual liquid chamber, the nozzle path, the circulation channel, and the discharge passage, when the nozzle is away from a connecting part between the nozzle path and the circulation channel, it is difficult for the fluid to flow in the vicinity of the nozzle. As a result, the air bubbles accumulated in the nozzle is hardly discharged. On the other hand, in Japanese Patent Application Laid-open No. 2017-65249, the central axis of the nozzle is positioned at the circulation channel side of the central axis of nozzle path as described above. Thus, the nozzle is closer to the connecting part between nozzle path and circulation channel as compared with the case where the central axis of the nozzle overlaps with the central axis of nozzle path. This ensures the discharge of the air bubbles accumulated in the nozzle.

However, in the liquid discharge head described in Japanese Patent Application Laid-open No. 2017-65249, when the liquid flows from the common liquid chamber to the circulating common channel via the supply-channel-side fluid resistive portion, the individual liquid chamber, nozzle path, circulation channel, and the discharge passage, the liquid is difficult to flow in a side, of the nozzle path, opposite to the circulation channel. Therefore, in the liquid discharge head of Japanese Patent Application Laid-open No. 2017-65249, the liquid tends to stagnate in the side, of the nozzle path, opposite to the circulation channel.

The object of the present disclosure is to provide a liquid discharge head in which the fluid is hard to stagnate.

SUMMARY

According to an aspect of the present disclosure, there is provided a liquid discharge head, including a channel unit including an individual channel, a first common channel, and a second common channel, wherein the first common channel and the second common channel are connected to the individual channel, wherein the individual channel includes:

a nozzle;

a pressure chamber disposed apart from the nozzle in a first direction;

a descender forming at least a part of a channel that connects the nozzle and the pressure chamber, positioned between the nozzle and the pressure chamber in the first direction, and extending in the first direction, wherein one end of the descender in the first direction is nearer to the nozzle than the other end of the descender;

a first connecting channel connecting the pressure chamber and the first common channel; and a second connecting channel positioned between the second common channel and the descender in a second direction orthogonal to the first direction, and connecting the second common channel and the one end of the descender, a central axis of the nozzle is positioned between the second common channel and a central axis of the descender in the second direction, the descender includes a first portion including the one end and a second portion positioned between the pressure chamber and the first portion in the first direction, and in an end, of the descender, opposite to the second connecting channel in the second direction, an inner wall defining the one end of the first portion protrudes toward the second connecting channel in the second direction beyond an inner wall defining the second portion.

DESCRIPTION OF THE EMBODIMENTS

A preferred embodiment of the present disclosure is explained below.

<Schematic Configuration of Printer 1>

Figure 1:
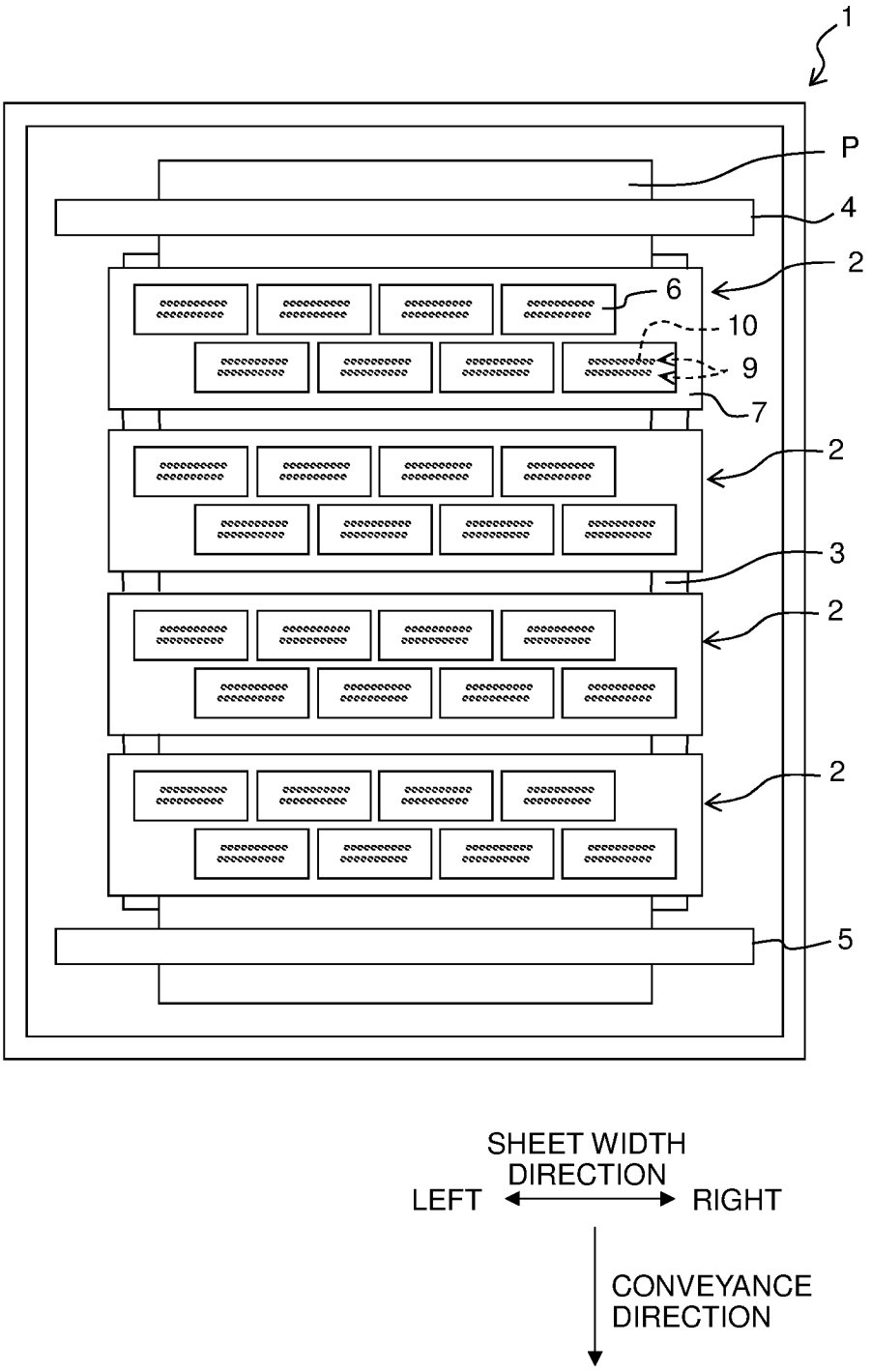
FIG. 1 depicts a schematic configuration of a printer according to an embodiment of the present disclosure.
Figure 2:
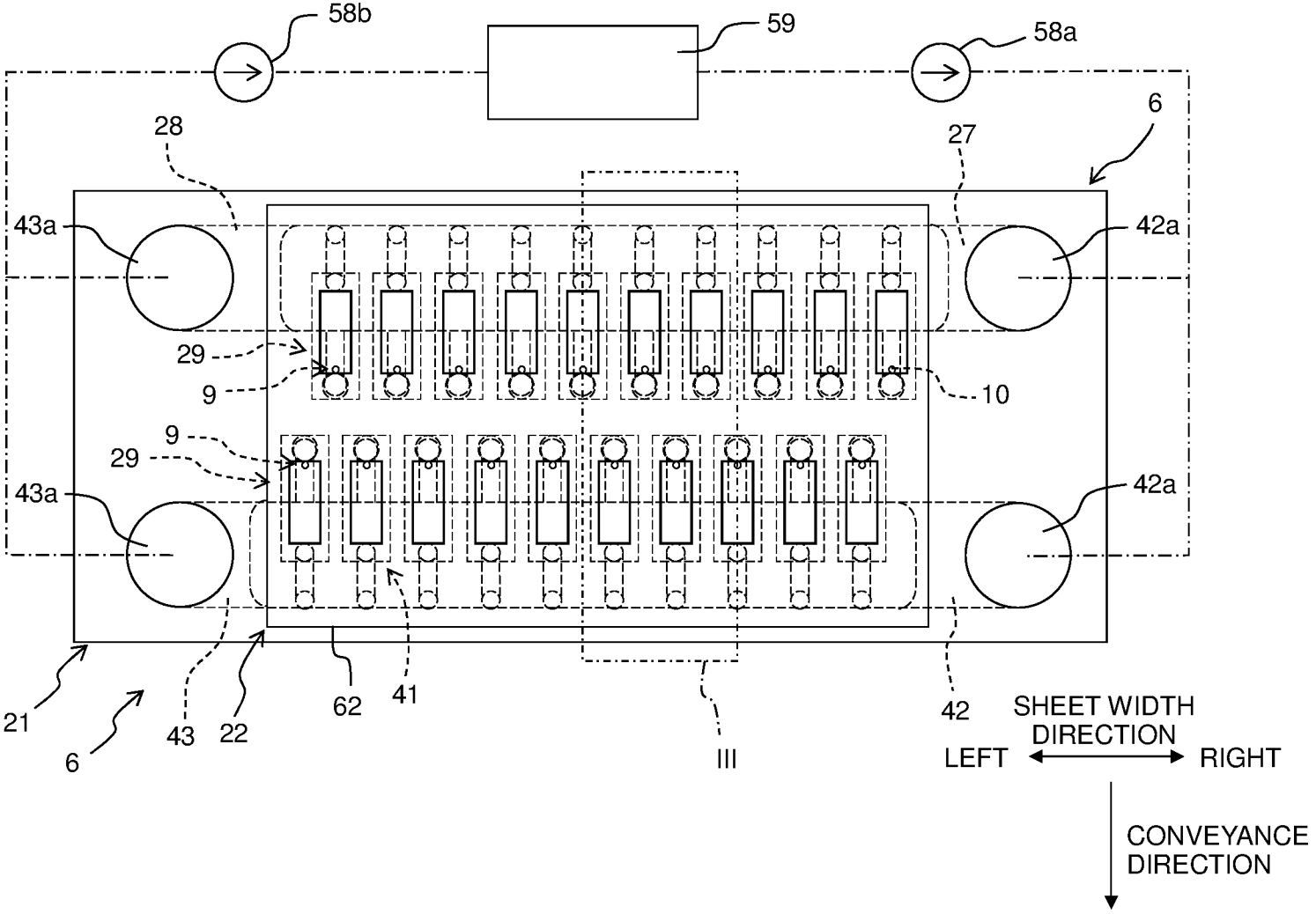
FIG. 2 is a plan view of an ink-jet head of FIG. 1.
Figure 3:
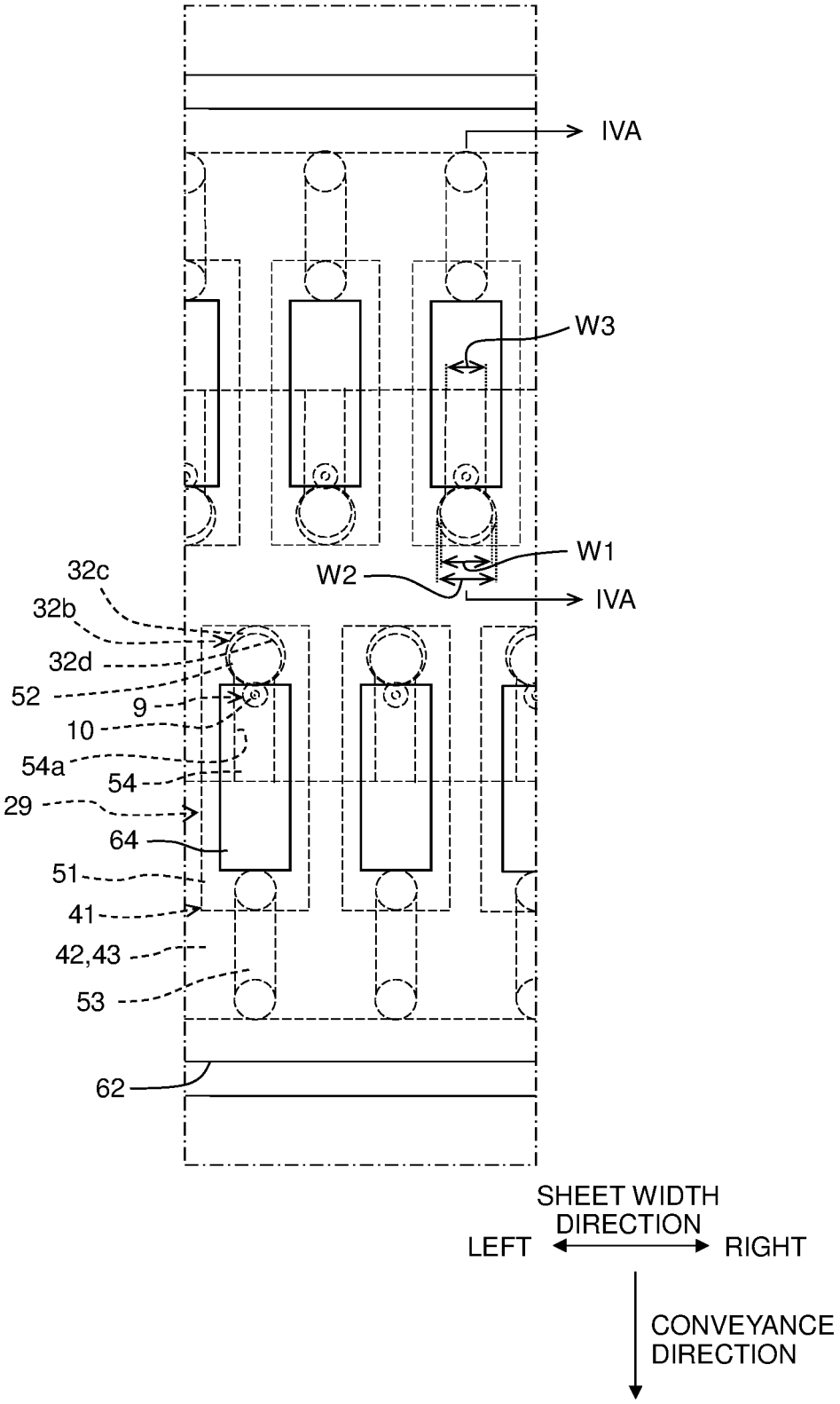
FIG. 3 is an enlarged view of a portion III in FIG. 2.

As depicted in FIG. 1, a printerl according to this embodiment includes four ink-jet heads 2, a platen 3, and conveyance rollers 4 and 5.

The four ink-jet heads 2 are arranged side by side in a horizontal conveyance direction ("a second direction" orthogonal to "a first direction (vertical direction)" of the present disclosure) in which a recording sheet P is conveyed. Each of the ink-jet heads 2 includes eight head units 6 ("a liquid discharge head" of the present disclosure) and a support member 7.

Each head unit 6 has nozzles 10. The nozzles 10 form a nozzle row 9 by being arranged at predefined nozzle intervals in a sheet width direction ("a third direction" orthogonal to "the first direction" and "the second direction" of the present disclosure) that is horizontal and orthogonal to the conveyance direction. The head unit 6 has two nozzle rows 9 arranged in the conveyance direction. The positions of the nozzles 10 belonging to one of the two nozzle rows 9 are shifted from those belonging to the other by half the predefined nozzle interval in the sheet width direction. In the present specification, a right side in the sheet width direction when the printer 1 is placed horizontally and when the printer 1 is seen from a downstream side in the conveyance direction is defined as "a right side in the sheet width direction", and a left side in the sheet width direction is defined as "a left side in the sheet width direction".

Of the eight head units 6 of one ink-jet head 2, four head units 6 are arranged in the sheet width direction to form a row of head units 6. In the ink-jet head 2, the head units 6 are arranged in two rows in the conveyance direction. The positions of the head units 6 forming an upstream side row in the conveyance direction are shifted in the sheet width direction from the positions of the head units 6 forming a downstream side row in the conveyance direction. A part of the nozzles 10 of the head units 6 forming the upstream side row in the conveyance direction overlaps in the conveyance direction with a part of the nozzles 10 of the head units 6 forming the downstream side row in the conveyance direction. Thus, the nozzles 10 of the eight head units 6 are arranged over an entire length of the recording sheet P in the sheet width direction. That is, the ink-jet head 2 is a so-called line head. The support member 7 is a rectangular plate-like member that is long in the sheet width direction. The support member 7 holds the eight head units 6 in the positional relationship described above.

In each ink-jet head 2, ink is discharged from the nozzles 10. In the four ink-jet heads 2, a black ink is discharged from the ink-jet head 2 arranged at the most upstream side in the conveyance direction, a yellow ink is discharged from ink-jet head 2 arranged at the second most upstream side in the conveyance direction, a cyan ink is discharged from the ink-jet head 2 arranged at the third most upstream side in the conveyance direction, and a magenta ink is discharged from the ink-jet head 2 arranged at the most downstream side in the conveyance direction.

The platen 3 is positioned below the four ink-jet heads 2. The platen 3 extends over the four ink-jet heads 2 in the conveyance direction. The platen 3 extends over an entire length of the ink-jet heads 2 in the sheet width direction. The platen 3 supports the recording sheet P during recording from below.

The conveyance roller 4 is disposed upstream of the four ink-jet heads 2 and the platen 3 in the conveyance direction. The conveyance roller 5 is disposed downstream of the four ink-jet heads 2 and the platen 3 in the conveyance direction. The conveyance rollers 4 and 5 convey the recording sheet P in the conveyance direction.

The printer 1 performs image recording on the recording sheet P by discharging the inks on the recording sheet P from the nozzles 10 of the four ink-jet heads 2 while conveying the recording sheet P in the conveyance direction by use of the conveyance rollers 4 and 5.

<Head Unit 6>

Subsequently, structure of the head unit 6 is explained in detail. As depicted in FIG. 2, FIG. 3, FIG. 4A, and FIG. 4B, the head unit 6 has a channel unit 21 and a piezoelectric actuator 22.

The channel unit 21 is formed by stacking nine plates 31 to 39 in this order in the vertical direction (an up-down direction, "the first direction" of the present disclosure) from below. The plate 31 is formed from, for example, a synthetic resin material such as polyimide. The plates 32 to 39 are formed from, for example, a metallic material such as SUS430 (stainless alloy). In this embodiment, the plate 31 corresponds to "a nozzle plate" of the present disclosure, and the plate 39 corresponds to "a pressure chamber plate" of the present disclosure. The plate 32 corresponds to "a first descender plate" of the present disclosure, and the plates 33 to 38 correspond to "a second descender plate" of the present disclosure. The plate 32 also corresponds to "a nozzle-side plate" included in the first descender plate of the present disclosure.

The channel unit 21 includes individual channels 41, two first common channels 42, and two second common channels 43.

Each individual channel 41 includes the nozzle 10, a pressure chamber 51, a descender 52, a first throttle channel 53 ("a first connecting channel" of the present disclosure), and a second throttle channel 54 ("a second connecting channel" of the present disclosure). The nozzles 10 are formed in the plate 31. The nozzles 10 forming the individual channels 41 form the two nozzle rows 9 as described above.

Figure 4A:
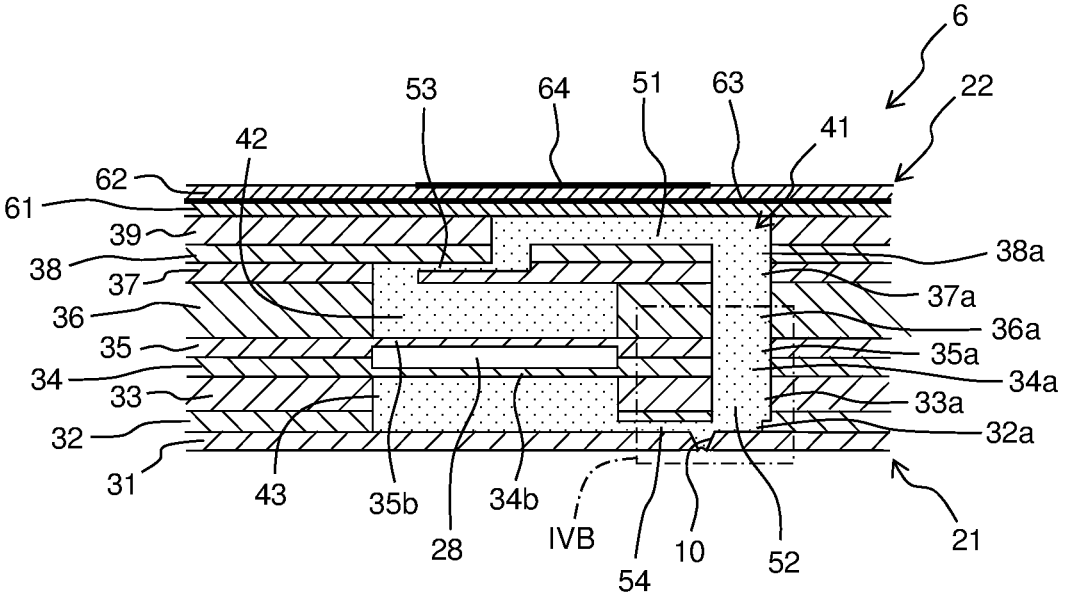
FIG. 4A is a cross-sectional view taken along a line IVA-IVA in FIG. 3.
Figure 4B:
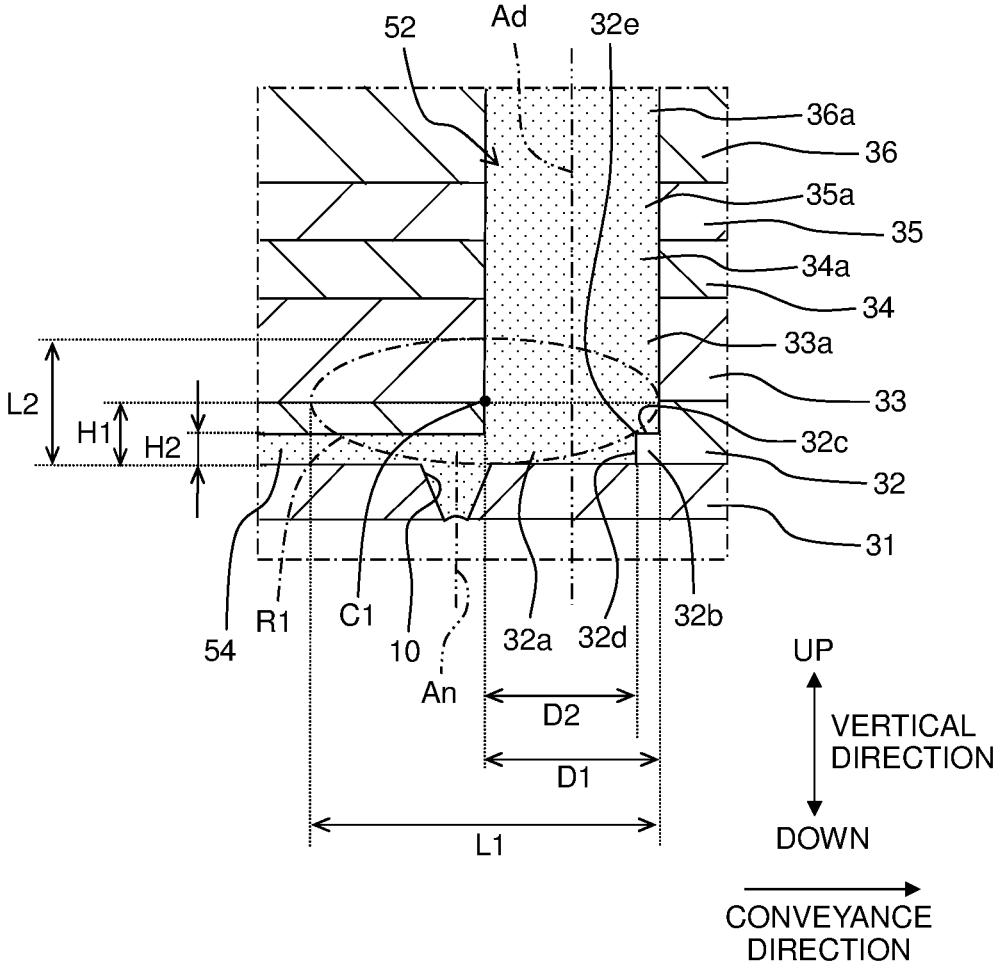
FIG. 4B is an enlarged view of a portion IVB in FIG. 4A.

In the present specification, "a first side (one side) in the conveyance direction" of each individual channel 41 may be distinguished from "a second side (the other side) in the conveyance direction" of each individual channel 41, as described below. In the conveyance direction, a side at which the second throttle channel 54 is disposed with respect to the descender 52 is "the first side in the conveyance direction". An opposite side thereof (a side at which the descender 52 is provided with respect to the second throttle channel 54) is "the second side in the conveyance direction". In this embodiment, each head unit 6 includes the two nozzle rows 9 arranged in the conveyance direction. In the individual channels 41 corresponding to the nozzle row 9 at the upstream side in the conveyance direction, the upstream side in the conveyance direction is "the first side in the conveyance direction", and the downstream side in the conveyance direction is "the second side in the conveyance direction". In the individual channels 41 corresponding to the nozzle row 9 at the downstream side in the conveyance direction, the downstream side in the conveyance direction is "the first side in the conveyance direction", and the upstream side in the conveyance direction is "the second side in the conveyance direction". FIGS. 4A and 4B each depict the individual channel 41 belonging to the nozzle row 9 at the upstream side in the conveyance direction. Thus, the left side in FIGS. 4A and 4B (the upstream side in the conveyance direction) is "the first side in the conveyance direction", and the right side in FIGS. 4A and 4B (the downstream side in the conveyance direction) is "the second side in the conveyance direction".

The pressure chambers 51 are formed in the plate 39. Each pressure chamber 51 has a rectangular shape in planar view that is long in the conveyance direction. A part at the second side in the conveyance direction of the pressure chamber 51 overlaps in the vertical direction with a part of the nozzle 10 corresponding thereto.

The descender 52 is formed by overlapping through holes 32*a* to 38*a* formed in the plates 32 to 38 with each other in the vertical direction. The descender 52 extends in the vertical direction. An upper end of the descender 52 is connected to the pressure chamber 51. A central axis An of the nozzle 10 is shifted from a central axis Ad of the descender 52. The central axis An of the nozzle 10 is positioned at the first side in the conveyance direction with respect to the central axis Ad of the descender 52. "The central axis Ad of the descender 52" extends in the vertical direction while passing through a center of gravity of a cross-section of a second portion of the descender 52 perpendicular to the vertical direction. In this embodiment, "the central axis Ad of the descender 52" is a central axis of the second portion (cylinder, column) of the descender of the present disclosure. The "central axis An of the nozzle 10" extends in the vertical direction while passing through a center of gravity of an opening of the nozzle 10 in a lower surface (nozzle surface) of the plate 31. In this embodiment, the through hole 32*a* corresponds to "a first portion the descender" of the present disclosure, and the through holes 33*a* to 38*a* correspond to "the second portion of the descender" of the present disclosure.

The through hole 32*a* (the first portion of the descender) has a lower portion and an upper portion. The lower portion of the through hole 32*a* is a lower end of the descender 52, and corresponds to "one end of the descender in the first direction" which is nearer to the nozzle 10 than the other end of the descender 52 of the present disclosure. The upper portion of the through hole 32*a* corresponds to "a pressure-chamber-side portion" of a through hole of the present disclosure. In the conveyance direction, a length (maximum length, diameter) D2 of the lower portion of the through hole 32*a* is shorter than a length (maximum length, diameter) D1 of the upper portion of the through hole 32*a* and the through holes 33*a* to 38*a* (D2<D1). Ends at the first side in the conveyance direction of the through holes 32*a* to 38*a* have the same position in the conveyance direction. The ends at the first side in the conveyance direction of the through holes 32*a* to 38*a* are positioned on the same straight line extending in the vertical direction. The plate 32 thus has a protruding wall portion (protruding wall) 32*b*. The protruding wall portion 32*b* is a part of a wall (inner wall) that defines the lower portion of the through hole 32*a*. The protruding wall portion 32*b* is provided at a lower portion of the plate 32. The protruding wall portion 32*b* protrudes from the both sides in the sheet width direction and the second side in the conveyance direction toward the inside of the through hole 32*a* (toward the central axis Ad of the descender 52). That is, the protruding wall portion 32*b* protrudes toward the inside of the descender 52 in the conveyance direction and the sheet width direction with respect to an inner wall defining the upper portion of the through hole 32*a*. Further, the protruding wall portion 32*b* protrudes toward the inside of the descender 52 in the conveyance direction and the sheet width direction with respect to an inner wall defining the through holes 33*a* to 38*a*. For example, the length D1 is about 175 μm, and the length D2 is about 150 μm. The protruding wall portion 32*b* protrudes about 25 μm with respect to ends at the second side in the conveyance direction of the upper portion of the through hole 32*a* and the through holes 33*a* to 38*a*.

Thus, in an end at the second side in the conveyance direction of the through hole 32*a*, its lower portion (nozzle 10 side) is positioned at the first side in the conveyance direction with respect to its upper portion (pressure chamber 51 side). An inner wall defining the through hole 32*a* of the plate 32 has a step or level difference between the upper portion and the lower portion. That is, in the lower portion of the through hole 32*a*, an end at the second side in the conveyance direction of the descender 52 is positioned at the first side in the conveyance direction with respect to the upper portion of the through hole 32*a* and the through holes 33*a* to 38*a*.

The cross-section of the upper portion of the through hole 32*a* perpendicular to the vertical direction is a circle, and the cross-section of the through holes 33*a* to 38*a* perpendicular to the vertical direction is a circle. Those circles have the same diameter. The upper portion of the through hole 32*a* is a cylinder or column, and the through holes 33*a* to 38*a* are a cylinder or column. The bottom surfaces of those cylinders have the same size. A central axis of the upper portion of the through hole 32*a* and a central axis of the through holes 33*a* to 38*a* are positioned on the central axis Ad of the descender 52. Thus, the ends at the second side in the conveyance direction, of the upper portion of the through hole 32*a* and the through holes 33*a* to 38*a* forming the descender 52, have the same position in the conveyance direction. The ends at the second side in the conveyance direction, of the upper portion of the through hole 32*a* and the through holes 33*a* to 38*a*, are positioned on the same straight line extending in the vertical direction. The ends at the first side in the conveyance direction of the through holes 32*a* to 38*a* forming the descender 52 have the same position in the conveyance direction. The ends at the first side in the conveyance direction of the through holes 32*a* to 38*a* are positioned on the same straight line extending in the vertical direction.

In the plate 32, a connecting portion between an upper surface 32*c* ("a second surface" of the present disclosure) of the protruding wall portion 32*b* and a side surface 32*d* ("a first surface" of the present disclosure) connected to an end at the first side in the conveyance direction of the upper surface 32*c* and extending downward in the vertical direction is a corner 32*e*. The corner 32*e* is positioned on a reference ellipse R1. In the reference ellipse R1, a position Cl that is an end of the through hole 32*a* at the upper side in the vertical direction and at the first side in the conveyance direction is the center, the conveyance direction is a long axis direction, and the vertical direction is a short axis direction. That is, the short axis of the reference ellipse R1 ("a first axis" of the present disclosure) extends in the vertical direction (the first direction), and the long axis of the reference ellipse R1 ("a second axis" of the present disclosure) extends in the conveyance direction (the second direction). A length L1 in the conveyance direction (long axis direction) of the reference ellipse R1 is twice the length D1 in the conveyance direction of the through holes 33*a* to 38*a* (the second portion of the descender). A length L2 in the vertical direction (short axis direction) of the reference ellipse R1 is twice a length H1 in the vertical direction of the through hole 32*a* (a part of the descender formed in the first descender plate, the first portion of the descender). That is, the length L2 of the short axis (first axis) of the reference ellipse R1 is twice the length H1 in the vertical direction. The length L1 of the long axis (second axis) of the reference ellipse R1 is twice the length D1 in the conveyance direction. For example, the length D1 is about 175 μm, the length D2 is about 150 μm, and the length H1 is about 50 μm. As a result, the length L1 is about 350 μm, and the length L2 is about 100 μm. A length (maximum length in the vertical direction, diameter) H2 in the vertical direction of the second throttle channel 54 described below is, for example, 25 μm.

The cross-section of the lower portion of the through hole 32*a* perpendicular to the vertical direction is a circle, of which diameter is smaller than that of the cross-section of the upper portion of the through hole 32*a* and the through holes 33*a* to 38*a* perpendicular to the vertical direction that is the circle as described above. Thus, the side surface 32*d* of the protruding wall portion 32*b* defining the lower portion of the through hole 32*a* extends in an arc. That is, the protruding wall portion 32*b* has the arc-like side surface 32*d* that is convex toward the outside of the descender 52 when seen from the vertical direction.

The first throttle channel 53 is formed over the plates 37 and 38. More specifically, an end at the second side in the conveyance direction of the first throttle channel 53 extends in the vertical direction over an upper portion of the plate 37 and the plate 38 and is connected to an end at the first side in the conveyance direction of the pressure chamber 51. The first throttle channel 53 extends from the connecting portion with the pressure chamber 51 toward the first side in the conveyance direction. An end at the first side in the conveyance direction of the first throttle channel 53 passes through the plate 38 to extend downward in the vertical direction, and is connected to the first common channel 42.

The second throttle channel 54 is formed in the lower portion of the plate 32. The second throttle channel 54 is positioned at the first side in the conveyance direction with respect to the descender 52. The second throttle channel 54 is connected to an end at the first side in the conveyance direction of the lower end of the descender 52 (the one end of the descender in the first direction of the present disclosure). The second throttle channel 54 extends from the connecting portion with the descender 52 toward the first side in the conveyance direction. In the sheet width direction, both ends of the second throttle channel 54 are positioned between both ends of the upper portion of the through hole 32*a* and the through holes 33*a* to 38*a*. In the sheet width direction, both ends of the lower portion of the through hole 32*a* are positioned between the both ends of the second throttle channel 54, and the both ends of the upper portion of the through hole 32*a* and the through holes 33*a* to 38*a*. Thus, a length W1 in the sheet width direction of the lower portion of the through hole 32*a* has a length between a length W2 in the sheet width direction of the upper portion of the through hole 32*a* and the through holes 33*a* to 38*a* and a length W3 in the sheet width direction of the second throttle channel 54 (W3<W1<W2). For example, the length W1 is about 150 μm, the length W2 is about 175 μm, and the length W3 is about 75 μm.

As described above, both ends in a circumferential direction of the arc-like side surface 32*d* are connected to an inner wall 54*a* of an end at the second side in the conveyance direction of the second throttle channel 54.

In this embodiment, the length (maximum length in the vertical direction, diameter) H2 in the vertical direction of the second throttle channel 54 is shorter than the length D1 in the conveyance direction of the upper portion of the through hole 32*a* and the through holes 33*a* to 38*a*. More specifically, the length H2 in the vertical direction of the connecting portion between the second throttle channel 54 and the descender 52 is shorter than the length D1 in the conveyance direction (H2<D1). Since the protrusion wall portion 32*b* is formed in the plate 32, the length D2 in the conveyance direction of the lower portion of the through hole 32*a* is shorter than the length D1 in the conveyance direction of the upper portion of the through hole 32*a* and the through holes 33*a* to 38*a*. The length D2 in the conveyance direction is a length between the length D1 in the conveyance direction and the length H2 in the vertical direction (H2<D2<D1).

In this embodiment, as described above, the central axis An of the nozzle 10 is shifted from the central axis Ad of the descender 52 such that the central axis An of the nozzle 10 is positioned at the first side in the conveyance direction with respect to the central axis Ad of the descender 52. The nozzle 10 thus overlaps in the vertical direction with the descender 52 and the second throttle channel 54. However, the positional shift or positional difference in the conveyance direction of the central axis An of the nozzle 10 with respect to the central axis Ad of the descender 52 may be smaller than that of this embodiment. In this case, the nozzle 10 may overlap in the vertical direction with the descender 52, and may not overlap in the vertical direction with the second throttle channel 54. Alternatively, the positional shift or positional difference in the conveyance direction of the central axis An of the nozzle 10 with respect to the central axis Ad of the descender 52 may be larger than that of this embodiment. In this case, the nozzle 10 may overlap in the vertical direction with the second throttle channel 54, and may not overlap in the vertical direction with the descender 52.

When the nozzle 10 overlaps in the vertical direction with the descender 52 and does not overlap in the vertical direction with the second throttle channel 54, the descender 52 connects the nozzle 10 and the pressure chamber 51. When the nozzle 10 overlaps in the vertical direction with the descender 52 and the second throttle channel 54, the descender 52 and the second throttle channel 54 connect the nozzle 10 and the pressure chamber 51. When the nozzle 10 overlaps in the vertical direction with the second throttle channel 54 and does not overlap in the vertical direction with the descender 52, the descender 52 and the second throttle channel 54 connect the nozzle 10 and the pressure chamber 51.

Corresponding to the configuration in which the nozzles 10 form the two nozzle rows 9 as described above, the individual channels 41 are arranged in the sheet width direction to form an individual channel row 29. The channel unit 21 includes two individual channel rows 29 arranged in the conveyance direction.

The two first common channels 42 are formed in the plate 36. The two first common channels 42 correspond to the two individual channel rows 29. Each first common channel 42 extends in the sheet width direction to overlap in the vertical direction with the first throttle channels 53 and parts at the first side in the conveyance direction of the pressure chambers 51 forming the corresponding individual channel row 29. Each first common channel 42 is connected to ends at the first side in the conveyance direction of the first throttle channels 53 of the individual channels 41 forming the corresponding individual channel row 29.

The two second common channels 43 are formed over the plates 32 and 33. The two second common channels 43 correspond to the two individual channel rows 29. Each second common channel 43 extends in the sheet width direction and overlaps in the vertical direction with the corresponding first common channel 42. Each second common channel 43 is connected to ends at the first side in the conveyance direction of the second throttle channels 54 of the individual channels 41 forming the corresponding individual channel row 29.

A damper chamber 28 is formed at a portion included in the plates 34 and 35 and overlapping in the vertical direction with the first common channel 42 and the second common channel 43. The damper chamber 28 is formed by overlapping a recess formed at a part of a lower surface of the plate 35 that overlaps in the vertical direction with the first common channel 42, with a recess formed at a part of an upper surface of the plate 34 that overlaps in the vertical direction with the second common channel 43. A part of the plate 35 positioned on the upper side of the damper chamber 28 is a damper 35*b* that is elastically deformed to inhibit the pressure variation in ink in the first common channel 42. A part of the plate 34 positioned on the lower side of the damper chamber 28 is a damper 34*b* that is elastically deformed to inhibit the pressure variation in ink in the second common channel 43.

Right ends in the sheet width direction of the two first common channels 42 extend upward in the vertical direction. A vibration plate 61 is disposed on an upper surface of the channel unit 21 as described below. The parts of the first common channels 42 extending upward in the vertical direction extend to an upper surface of the vibration plate 61. An upper end of each first common channel 42 is a first connecting opening 42*a* that is opened in the upper surface of the vibration plate 61. The first connecting openings 42*a* of the two first common channels 42 are connected to an ink tank 59 via tubes or the like (not depicted). A pump 58*a* is provided in a channel connecting the two first connecting openings 42*a* and the ink tank 59. The pump 58*a* feeds ink from the ink tank 59 to the first connecting openings 42*a*.

Left ends in the sheet width direction of the two second common channels 43 extend upward in the vertical direction. The parts of the second common channels 43 extending upward in the vertical direction extend to the upper surface of the vibration plate 61. An upper end of each second common channel 43 is a second connecting opening 43*a* that is opened in the upper surface of the vibration plate 61. The second connecting openings 43*a* of the two second common channels 43 are connected to the ink tank 59 via tubes or the like (not depicted). A pump 58*b* is provided in a channel connecting the two second connecting openings 43*a* and the ink tank 59. The pump 58*b* feeds ink from second connection openings 43*a* to the ink tank 59.

When driven, the pumps 58*a* and 58*b* feed ink. This allows ink in the ink tank 59 to flow into the first common channels 42 through the first connecting openings 42*a*. Ink in the first common channels 42 flows from the first throttle channels 53 into the individual channels 41. Ink in the individual channels 41 flows through the first throttle channels 53, the pressure chambers 51, the descenders 52, and the second throttle channels 54 in this order, and flows out into the second common channels 43 through the second throttle channels 54. Ink in the second common channels 43 flows out from the second connecting ports 43*a* and returns to the ink tank 59. Accordingly, ink circulates between the head unit 6 and the ink tank 59. Only one of the pumps 58*a* and 58*b* may be provided. In this case also, ink can circulate between the ink tank 59 and the head unit 6 by driving the pump.

The piezoelectric actuator 22 includes the vibration plate 61, a piezoelectric layer 62, a common electrode 63, and the individual electrodes 64. The vibration plate 61 is formed from a piezoelectric material that includes lead zirconate titanate as a main component. The lead zirconate titanate is a mixed crystal of lead titanate and lead zirconate. The vibration plate 61 is disposed on the upper surface of the channel unit 21 (the upper surface of the plate 39) to cover the pressure chambers 51. The piezoelectric layer 62 is formed from the above piezoelectric material. The piezoelectric layer 62 is disposed on the upper side of the vibration plate 61 to extend continuously over the pressure chambers 51. In this embodiment, the vibration plate 61 and the piezoelectric layer 62 are formed from the piezoelectric material. The vibration plate 61, however, may be formed from any other insulative material than the piezoelectric material, such as a synthetic resin material.

The common electrode 63 is disposed between the vibration plate 61 and the piezoelectric layer 62 to extend over the pressure chambers 51. The common electrode 63 is connected to a power source (not depicted) and kept at the ground potential. The individual electrodes 64 are disposed on an upper surface of the piezoelectric layer 62. The individual electrodes 64 are provided corresponding to the respective pressure chambers 51. Each of the individual electrodes 64 overlaps in the vertical direction with a center portion of the corresponding one of the pressure chambers 51. The individual electrodes 64 are connected to a driver IC (not depicted). The driver IC selectively applies any of the ground potential and a driving potential (e.g., about 20 V) to the individual electrodes 64. Corresponding to this arrangement of the common electrode 63 and the individual electrodes 64, parts of the piezoelectric layer 62 interposed between the common electrode 63 and the respective individual electrodes 64 are polarized in its thickness direction.

Here, explanation is made about a method of driving the piezoelectric actuator 22 to discharge ink from the nozzle 10. In the piezoelectric actuator 22 having a standby state where no ink is discharged from the nozzle 10, the potential of all the individual electrodes 64 is kept at the ground potential that is the same as the common electrode 63. When ink is discharged from a certain nozzle 10, the potential of the individual electrode 64 corresponding to the certain nozzle 10 is switched from the ground potential to the driving potential. Then, the potential difference between the individual electrode 64 and the common electrode 63 generates an electric field in the thickness direction parallel to a polarization direction in a portion of the piezoelectric layer 62 interposed between the individual electrode 64 and the common electrode 63. This electric field causes the interposed portion of the piezoelectric layer 62 to contract in the sheet width direction and the conveyance direction orthogonal to the polarization direction. A portion of the piezoelectric layer 62 and the vibration plate 61 overlapping in the vertical direction with the pressure chamber 51 is deformed to be convex toward the pressure chamber 51 side as a whole. The volume of the pressure chamber 51 is thus reduced to increase the pressure of ink in the pressure chamber 51, thereby discharging ink from the nozzle 10 communicating with the pressure chamber 51. After ink is discharged from the nozzle 10, the potential of the individual electrode 64 returns to the ground potential from the driving potential. Then, the piezoelectric layer 62 and the vibration plate 61 return to the state before deformation.

<Effect>

As described above, when ink circulates between the ink tank 59 and the head unit 6, ink flows from the descender 52 to the second throttle channel 54. In this situation, ink flows through the lower end of the descender 52 toward the connecting portion with the second throttle channel 54 (i.e., toward the first side in the conveyance direction).

In this embodiment, the central axis An of the nozzle 10 is shift from the central axis Ad of the descender 52 such that the central axis An of the nozzle 10 is positioned at the first side in the conveyance direction (the second throttle channel 54 side) with respect to the central axis Ad of the descender 52. Thus, when ink flows from the descender 52 to the second throttle channel 54 as described above, the flow rate (flow velocity) of ink at a position close to the nozzle 10 is high. This makes it possible to efficiently discharge air bubbles in the nozzle 10. However, in this case, at the lower end of the descender 52, the flow rate of ink at the end at the second side in the conveyance direction (the side opposite to the second throttle channel 54) is low.

Figure 5:
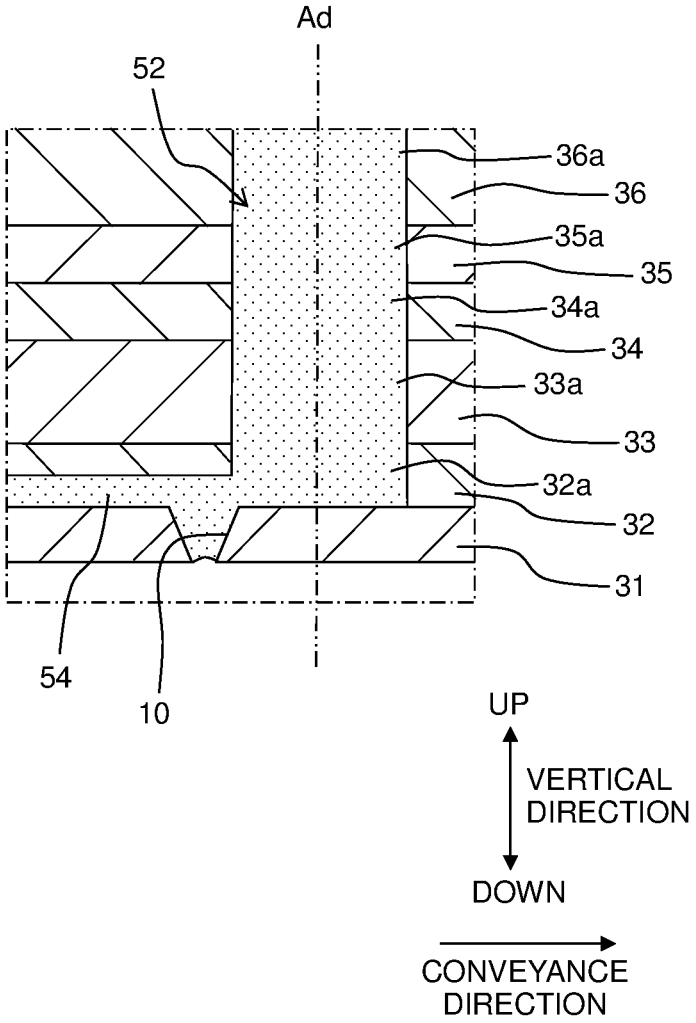
FIG. 5 depicts a configuration in which an end at a second side in a conveyance direction of a descender has no step (no level difference), and FIG. 5 corresponds to FIG. 4B of the embodiment of the present disclosure.

Here, it is assumed that the plate 32 has no protruding wall portion 32*b*, all of the through holes 32*a* to 38*a* are circles with the same diameter, and all the center portions of the through holes 32*a* to 38*a* are on the central axis Ad of the descender 52, as depicted in FIG. 5. That is, it is assumed that the position in the conveyance direction of the end at the second side in conveyance direction of the descender 52 does not vary depending on the position in the vertical direction. In this case, the flow rate of ink is low at the end at the second side in the conveyance direction of the lower end of the descender 52, and thus ink is likely to stagnate.

On the other hand, in this embodiment, the end at the second side in the conveyance direction of the lower end of the descender 52 (the lower portion of the through hole 32*a*) is positioned at the first side in the conveyance direction (the second throttle channel 54 side) with respect to the end at the second side in the conveyance direction of a portion at the upper side of the lower end of the descender 52 (the upper portion of the through hole 32*a* and the through holes 33*a* to 38*a*). In other words, in the end at the second side in the conveyance direction of the descender 52, namely, in the end, of the descender 52, opposite to the second throttle channel 54 in the conveyance direction, the inner wall defining the lower portion of the through hole 32*a* protrudes toward the second throttle channel 54 in the conveyance direction (i.e., toward the central axis Ad of the descender 52) beyond the inner wall defining the through holes 33*a* to 38*a*. It is thus possible to reduce the part of the lower end of the descender 52 where ink is not likely to flow when ink flows from the descender 52 to the second throttle channel 54. This inhibits ink from stagnating at the lower end of the descender 52.

In this embodiment, the length D1 in the conveyance direction of the upper portion of the through hole 32*a* and the through holes 33*a* to 38*a* is longer than the length H2 in the vertical direction of the connecting portion of the second throttle channel 54 with the descender 52 (H2<D1). The length D2 in conveyance direction of the lower portion of the through hole 32*a* (the one end of the descender in the first direction) is a length between the length D1 and the length H2 (H2<D2<D1). This makes the descender 52 narrower toward the second throttle channel 54. As a result, for example, ink flows more smoothly from the descender 52 to the second throttle channel 54 than a case where the length in the conveyance direction of the descender 52 is constant regardless of the position in the vertical direction and the entirety of lower end of the descender 52 is positioned at the first side in the conveyance direction with respect to the upper portion of the through hole 32*a*.

In this embodiment, in the plate 32, the end at the second side in the conveyance direction of the lower portion of the through hole 32*a* is positioned at the first side in the conveyance direction (the second throttle channel 54 side) with respect to the end at the second side in the conveyance direction of the upper portion of the through hole 32*a*. Such a through hole 32*a* can be formed relatively easy, for example, by half-etching.

Alternatively, it is possible to form a step (level difference) similar to the step of the through hole 32*a* by the following method. For example, instead of the plate 32, two plates having a thickness of about half of the plate 32 are stacked on top of each other. A through hole corresponding to the upper portion of the through hole 32*a* is formed in the upper plate of the two plates. A through hole corresponding to the lower portion of the through hole 32*a* is formed in the lower plate of the two plates. However, in this case, there is a fear that the dimensional accuracy of the step may deteriorate due to the deviation at the time of joining the two plates.

On the other hand, when the through hole 32*a* having the step is formed in one plate 32 like this embodiment, it is not necessary to join the plates. The step in the through hole 32*a* is thus not affected by the deviation of joining the plates. This allows the step in the through hole 32*a* to have high dimensional accuracy.

In this embodiment, it is assumed that the end at the second side in the conveyance direction of the descender 52 is a surface along the reference ellipse R1. In this configuration, ink smoothly flows along a wall surface of the descender 52 that extends along the reference ellipse R1 when ink flows from the descender 52 to the second throttle channel 54. On the other hand, it is assumed that a wall (inner wall) at the second side in the conveyance direction of the descender 52 has a portion protruding inward beyond the reference ellipse R1. In this configuration, ink collides with the portion of the wall of the descender 52 protruding inward beyond the reference ellipse R1 when ink flows from the descender 52 to the second throttle channel 54. Thus, ink is not likely to flow smoothly.

In this embodiment, the corner 32*e* at the end at the second side in the conveyance direction of the through hole 32*a* is positioned on the reference ellipse R1. Any other portion than the corner 32*e* is positioned at the second side in the conveyance direction (the outside of the reference ellipse R1) with respect to the reference ellipse R1. In other words, one end, of the through hole 32*a*, opposite to the second throttle channel 54 in the conveyance direction is positioned on the reference ellipse R1 or positioned further away from the second throttle channel 54 in the conveyance direction than the reference ellipse R1. As a result, the wall at the second side in the conveyance direction of the descender 52 does not have a portion positioned inside the reference ellipse R1, and thus ink can smoothly flow from the descender 52 to the second throttle channel 54 along the reference ellipse R1. The center (C1) of the reference ellipse R1 is located at the other end, of the through hole 32*a* (the first portion) of the descender 52, in the conveyance direction and at a boundary end, of the through hole 32*a*. The boundary end is a boundary between the through hole 32*a* (the first portion) and the through holes 33*a* to 38*a* (the second portion). The corner 32*e* is the connecting portion of the side surface 32*d* (the first surface) and the upper surface 32*c* (the second surface). The side surface 32*d* extends in the vertical direction and includes a first end and a second end that is located further away from the pressure chamber 51 than the first end in the vertical direction. The upper surface 32*c* connects to the first end of the side surface 32*d*, and extends from the first end to an opposite side to the second throttle channel 54 in the second direction. The first end of the side surface 32*d* is the corner 32*e*.

In this embodiment, in the sheet width direction, both ends of the second throttle channel 54 are positioned between both ends of the upper portion of the through hole 32*a* and the through holes 33*a* to 38*a*. Further, in the sheet width direction, both ends of the lower portion of the through hole 32*a* are positioned between the both ends of the second throttle channel 54, and the both ends of the upper portion of the through hole 32*a* and the through holes 33*a* to 38*a*. Thus, in the sheet width direction, both ends of the connecting portion of the second throttle channel 54 with the descender 52 are positioned between the both ends of the lower portion of the through hole 32*a* (positioned inside). In the sheet width direction, the both ends of the lower portion of the through hole 32*a* are positioned between the both ends of the upper portion of the through hole 32*a* and the through holes 33*a* to 38*a* (positioned inside). The length (maximum length, diameter) W1 in the sheet width direction of the lower portion of the descender 52 (the one end of the descender in the first direction) has a length between the length (maximum length, diameter) W2 in the sheet width direction of the upper portion of the through hole 32*a* (the pressure-chamber-side portion) and the through holes 33*a* to 38*a* and the length (the length in the sheet width direction of the connecting portion of the second throttle channel with the descender, maximum length, diameter) W3 in the sheet width direction of the second throttle channel 54 (W3<W1<W2). The descender 52 thus becomes narrower toward the second throttle channel 54. As a result, ink flows more smoothly from the descender 52 to the second throttle channel 54 than a case where the length in the sheet width direction of the descender 52 is constant.

The side surface 32*d* of the protruding wall portion 32*b* forming the inner wall of the descender 52 is formed in an arc shape, and both ends in the circumferential direction of the side surface 32*d* are connected to the end at the second side in the conveyance direction of the inner wall 54*a* of the second throttle channel 54. As a result, when ink flows from the descender 52 to the second throttle channel 54, ink can smoothly flow along the side surface 32*d*.

In this embodiment, the second throttle channel 54 is formed in the lower portion of the plate 32, and the upper portion of the plate 32 forms an upper inner wall of the second throttle channel 54. In other words, the second throttle channel 54 is defined by a recess formed in a surface (lower surface) of the plate 32 that faces the plate 31 and a surface (upper surface) of the plate 31 that covers the recess. It is thus possible to form the second throttle channel 54 in the plate 32 by half-etching. Since the upper inner wall of the second throttle channel 54 is formed by the upper portion of the plate 32, another plate is not required to form the upper inner wall of the second throttle channel 54 and the number of plates can be reduced.

In this embodiment, the position in the conveyance direction of the end at the first side (the second throttle channel 54 side) in the conveyance direction of the descender 52 does not vary depending on the position in the vertical direction. In other words, the inner wall of the descender 54 at the first side in the conveyance direction (at a side near to the second throttle channel 54 in the conveyance direction) forms a straight line extending in the vertical direction, when seen from sheet width direction. Thus, ink is not likely to stagnate at the end at the first side (the second throttle channel 54 side) in the conveyance direction of the lower end of the descender 52.

<Modifications>

The preferred embodiment of the present disclosure is explained above. The present disclosure, however, is not limited to the embodiment described above, and various changes or modifications may be made without departing from the claims.

For example, in the above embodiment, the lower portion of the plate 32 has the protruding wall portion 32*b*. Thus, the end at the second side in the conveyance direction of the lower portion of the through hole 32*a* is positioned at the first side in the conveyance direction with respect to the end at the second side in the conveyance direction of the upper portion of the through hole 32*a* and the through holes 33*a* to 38*a*. The present disclosure, however, is not limited thereto.

Figure 6:
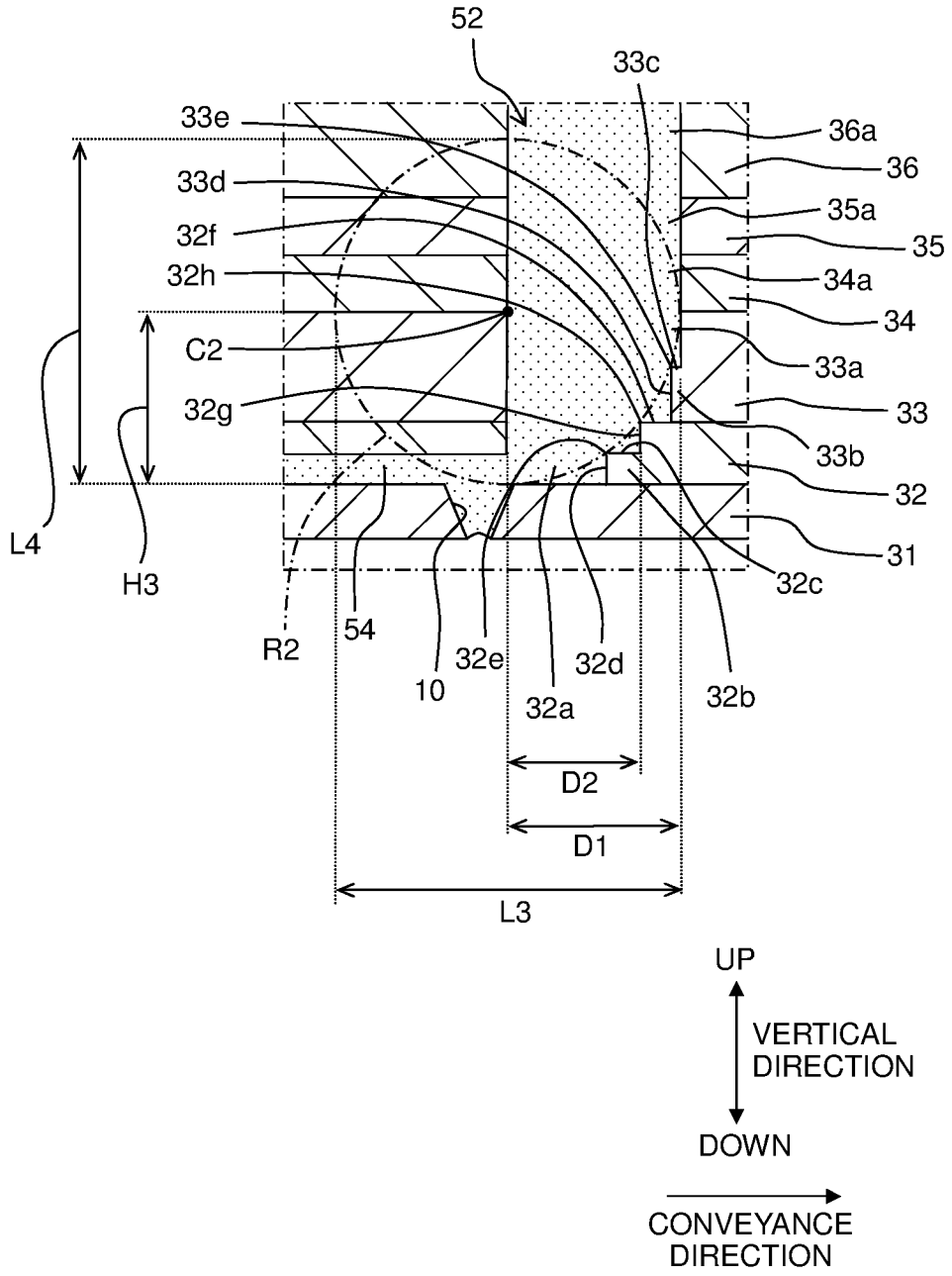
FIG. 6 depicts a first modification and corresponds to FIG. 4B of the embodiment of the present disclosure.

In a first modification, as depicted in FIG. 6, an end at the second side in the conveyance direction of the entire through hole 32*a* is positioned at the first side in the conveyance direction with respect to the above embodiment. In the first modification, for example, the protruding wall portion 32*b* protrudes approximately 70 μm from an inner wall of the through holes 34*a* to 38*a*. For example, an inner wall at the second side in the conveyance direction of the upper portion of the through hole 32*a* of the plate 32 protrudes approximately 50 μm from the inner wall of the through holes 34*a* to 38*a*. The plate 33 has a protruding wall portion 33*b*. The protruding wall portion 33*b* is a part of an inner wall defining the through hole 33*a*. The protruding wall portion 33*b* is provided at a lower portion of the plate 33. The protruding wall portion 33*b* protrudes from the both sides in the sheet width direction and the second side in the conveyance direction toward the inside of the through hole 33*a*. For example, the protruding wall portion 33*b* protrudes approximately 15 μm from the inner wall of the through holes 34*a* to 38*a*. In the first modification, the plates 32 and 33 correspond to "the first descender plate" of the present disclosure, and the plates 34 to 38 correspond to "the second descender plate" of the present disclosure.

In the first modification, similar to the above embodiment, the connecting portion between the upper surface 32*c* and the side surface 32*d* of the protruding wall portion 32*b* is the corner 32*e*. Further, in the first modification, a connecting portion between a part of an upper surface 32*f* of the plate 32 positioned inside the through holes 33*a* to 38*a* and a side surface 32*g* of the plate 32 connected to an end at the first side in the conveyance direction of the upper surface 32*f* and extending in the vertical direction is a corner 32*h*. Furthermore, in the plate 33 of the first modification, a connection portion between an upper surface 33*c* of the protruding wall portion 33*b* and a side surface 33*d* connected to an end at the first side in the conveyance direction of the upper surface 33*c* and extending in the vertical direction is a corner 33*e*.

In the first modification, the side surface 32*d* of the protruding wall portion 32*b*, the side surface 32*g* of the plate 32, and the side surface 33*d* of the protruding wall portion 33*b* correspond to "the first surface" of the present disclosure. In the first modification, the upper surface 32*c* of the protruding wall portion 32*b*, the upper surface 32*f* of the plate 32, and the upper surface 33*c* of the protruding wall portion 33*b* correspond to "the second surface" of the present disclosure.

In the first modification, the three corners 32*e*, 32*h*, and 33*e* are positioned on a reference circle R2. The reference circle R2 is centered on a position C2, which is positioned at the first side in the conveyance direction of the through hole 33*a* and at an upper end in the vertical direction of the through hole 33*a*. In the first modification, a length H3 in the vertical direction of a part formed by the through hole 32*a* and the through hole 33*a* of the descender 52 ("the first portion" of the descender of the present disclosure) is equal to a length D1 in the conveyance direction of the through holes 34*a* to 38*a* ("the second portion" of the descender of the present disclosure). A radius of the reference circle R2 is equal to the lengths D1 and H3. For example, the lengths D1 and H3 are about 300 μm. It can be also said that the reference circle R2 in the first modification is an ellipse in which a length L3 in the conveyance direction (a length in the long axis direction) is equal to a length L4 in the vertical direction (a length in the short axis direction). The reference circle R2 corresponds to "a reference ellipse" of the present disclosure.

In the first modification, the part formed by the through holes 32*a* and 33*a* (the first portion of the descender) has a step-like shape in which a lower portion (a portion closer to the nozzle 10 in the vertical direction) of the end at the second side in the conveyance direction (the side opposite to the second throttle channel 54) is positioned at the first side in the conveyance direction (the second throttle 54 side) with respect to an upper portion thereof. That is, an inner wall included in the part formed by the through holes 32*a* and 33*a* and defining the end at the second side in the conveyance direction is provided with a staircase structure approaching the nozzle 10 in the conveyance direction and the vertical direction. Thus, ink can flow smoothly from the descender 52 to the second throttle channel 54.

In the first modification, the end of the descender 52 having the step-like shape (staircase structure) is formed by the through holes 32*a* and 32*b* of the two plates 32 and 33. That is, the two plates 32 and 33 are "the first descender plate" of the present disclosure. It is thus possible to increase the number of steps included in the step-like end of the descender 52 compared to a case where the first descender plate is one plate.

In the first modification, the three corners 32*e*, 32*h*, and 33*e* are positioned on the reference circle R2 corresponding to "the reference ellipse" of the present disclosure. That is, in the ends at the second side in the conveyance direction of the through holes 32*a* and 33*a*, the corners 32*e*, 32*h*, and 33*e* are positioned on the reference circle R2, and any other portion than the corners 32*e*, 32*h*, and 33*e* is positioned at the second side in the conveyance direction with respect to the reference circle R2 (outside the reference circle R2). This eliminates a part included in the wall (inner wall) at the second side in the conveyance direction of the descender 52 and positioned inside the reference circle R2, thus allowing ink to flow from the descender 52 to the second throttle channel 54 smoothly. In this configuration, since ink flows along the reference circle R2, ink flows more smoothly than a case where ink flows along a reference ellipse having different lengths in the long axis direction and the short axis direction.

In the first modification, the length D1 is equal to the length H3. The present disclosure, however, is not limited thereto. The length H3 may be shorter than the length D1 or longer than the length Dl. When the length H3 is shorter than the length D1, the three corners 32*e*, 32*h*, and 33*e* may be positioned on an ellipse centered on the position C2, in which a length in the conveyance direction (long axis direction) is twice as long as the length D1 and a length in the vertical direction (short axis direction) is twice as long as the length H3. When the length H3 is longer than the length D1, the three corners 32*e*, 32*h*, and 33*e* may be positioned on an ellipse centered on the position C2, in which a length in the conveyance direction (short axis direction) is twice as long as the length D1 and a length in the vertical direction (long axis direction) is twice as long as the length H3.

In the first modification, the inner wall having the step-like shape of the descender 52 is formed by the two plates 32 and 33. The present disclosure, however, is not limited thereto. The inner wall having the step-like shape of the descender 52 may be formed by three or more plates including the plate 32 and arranged continuously in the vertical direction. The number of steps included in the inner wall having the step-like shape can be increased, as the number of plates forming the inner wall having the step-like shape of the descender 52 is increased.

In each of the above embodiment and the first modification, the corner(s) is/are positioned on the reference ellipse R1 or the reference circle R2. The present disclosure, however, is not limited thereto. For example, in the above embodiment, the corner 32*e* may be positioned at the second side in the conveyance direction with respect to the reference ellipse R1. Further, for example, in the first modification, the corners 32*e*, 32*h*, and 33*e* may be positioned at the second side in the conveyance direction with respect to the reference circle R2. In either case, since the wall of the descender 52 has no portion positioned inside the reference ellipse R1 or the reference circle R2, ink flows smoothly along the reference ellipse R1 or the reference circle R2 in the descender 52.

Alternatively, for example, in the above embodiment, the corner 32*e* may be positioned at the first side in the conveyance direction with respect to the reference ellipse R1. Further, for example, in the first modification, the corners 32*e*, 32*h*, and 33*e* may be positioned at the first side in the conveyance direction with respect to the reference circle R2. That is, the end at the second side in the conveyance direction of the descender 52 may have a portion positioned inside the reference ellipse.

In the above embodiment, the plates 32 to 39 are formed from a metallic material. The present disclosure, however, is not limited thereto. For example, plates 32 to 39 may be formed from silicon. When the plates 32 to 39 are formed from silicon, more complicated processing can be performed compared to the case where the plates 32 to 39 are formed from the metallic material. Thus, in this case, the plate 32 can be formed having the inner wall having the step-like shape of the descender 52 even when the first descender plate is formed only by the plate 32.

In the above embodiment, the second throttle channel 54 is formed in the lower portion of the plate 32. The present disclosure, however, is not limited thereto. For example, the second throttle channel 54 is not formed in the plate 32, and another plate in which the second throttle channel 54 is formed over its entire area in the vertical direction is provided between the plate 32 and the plate 31. The upper inner wall of the second throttle channel 54 may be formed by the plate 32, and the lower inner wall of the second throttle channel 54 is formed by the plate 31. In this case, the descender 52 extends in the vertical direction to the other plate formed having the second throttle channel 54, and is connected to the second throttle channel 54.

Figure 7:
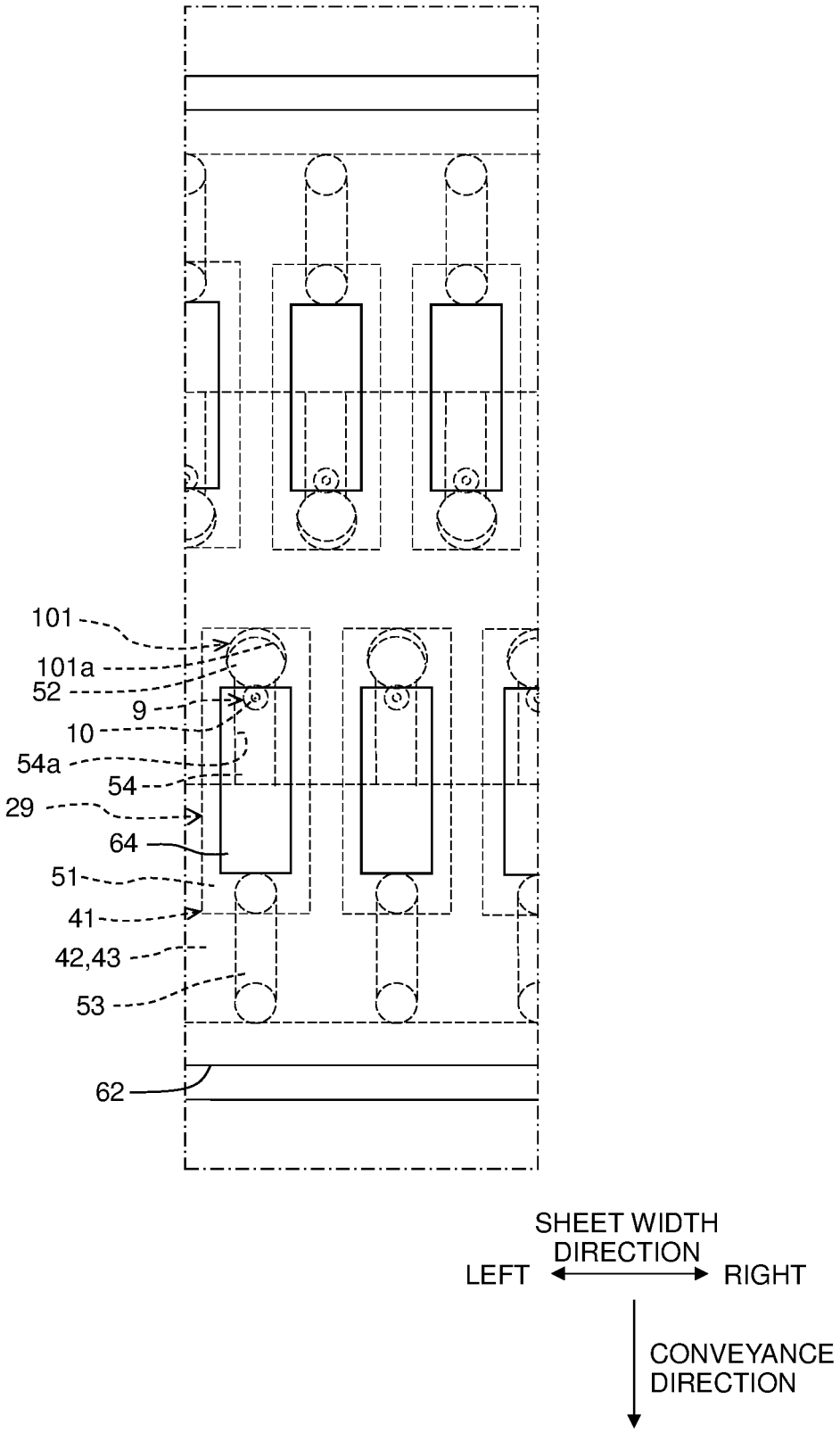
FIG. 7 depicts a second modification and corresponds to FIG. 3 of the embodiment of the present disclosure.

In the above embodiment, both ends in the circumferential direction of the arc-like side surface 32*d* of the protruding wall portion 32*b* are directly connected to the end at the second side in the conveyance direction of the inner wall 54*a* of the second throttle channel 54. The present disclosure, however, is not limited thereto. In the second modification, protrusion of a protruding wall portion 101 is smaller than that of the protruding wall portion 32*b* of the above embodiment. As depicted in FIG. 7, ends in a circumferential direction of a side surface 101*a* of the protruding wall portion 101 are positioned at the second side in the conveyance direction with respect to the second throttle channel 54. That is, the ends in the circumferential direction of the side surface 101*a* of the protruding wall portion 101 are not directly connected to the inner wall surface 54*a* of the second throttle channel 54.

In the above embodiment, the lengths in the conveyance direction and the sheet width direction of the lower portion of the through hole 32*a* are shorter than those of the upper portion of the through hole 32*a* and the through holes 33*a* to 38*a*. The present disclosure, however, is not limited thereto. For example, the length in the conveyance direction of the lower portion of the through hole 32*a* may be shorter than that of the upper portion of the through hole 32*a* and the through holes 33*a* to 38*a*, and the length in the sheet width direction of the lower portion of the through hole 32*a* may be the same as that of the upper portion of the through hole 32*a* and the through holes 33*a* to 38*a*.

In the above embodiment, the position in the conveyance direction of the end at the first end in the conveyance direction of the descender 52 does not vary depending on the position in the vertical direction. The present disclosure, however, is not limited thereto. For example, the above embodiment may be changed as follows. That is, a cross-section perpendicular to the vertical direction of the lower portion of the through hole 32*a* may be a circle with the same diameter as a cross-section perpendicular to the vertical direction of the upper portion of the through hole 32*a* and the through holes 33*a* to 38*a*. The lower portion of the through hole 32*a* is positioned at the first side in the conveyance direction with respect to the upper portion of the through hole 32*a* and the through holes 33*a* to 38*a*. Also in this case, the end at the second side in the conveyance direction of the lower portion of the through hole 32*a* is positioned at the first side in the conveyance direction with respect to the end at the second side in the conveyance direction of the upper portion of the through hole 32*a* and the through holes 33*a* to 38*a*.

In this case, the end at the first side in the conveyance direction of the lower portion of the through hole 32*a* is positioned at the first side in the conveyance direction with respect to the end at the first side in the conveyance direction of the upper portion of the through hole 32*a* and the through holes 33*a* to 38*a*. Further, in this case, the length (maximum length, diameter) in the conveyance direction of the descender 52 is substantially constant regardless of the position in the vertical direction.

In the above embodiment and modification(s), the protruding wall portion is provided at the lower portion of the first descender plate. The present disclosure, however, is not limited thereto.

Figure 8A:
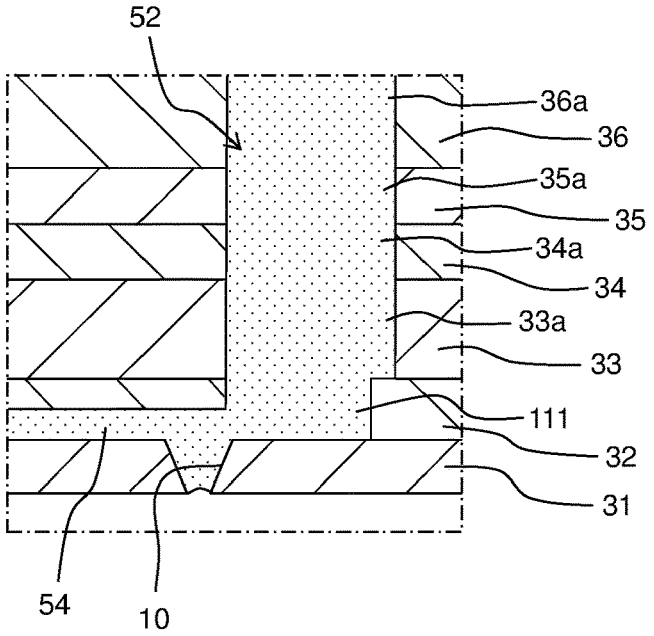
FIG. 8A depicts a third modification and corresponds to FIG. 4B of the embodiment of the present disclosure.

For example, the above embodiment may be changed in a third modification, as follows. In the third modification, as depicted in FIG. 8A, the position in the conveyance direction of an end at the second side in the conveyance direction of a through hole 111 of the plate 32 does not vary depending on the position in the vertical direction. The end at the second side in the conveyance direction of the through hole 111 is positioned at the first side in the conveyance direction with respect to an end at the second side in the conveyance direction of the through holes 33*a* to 38*a*.

Figure 8B:
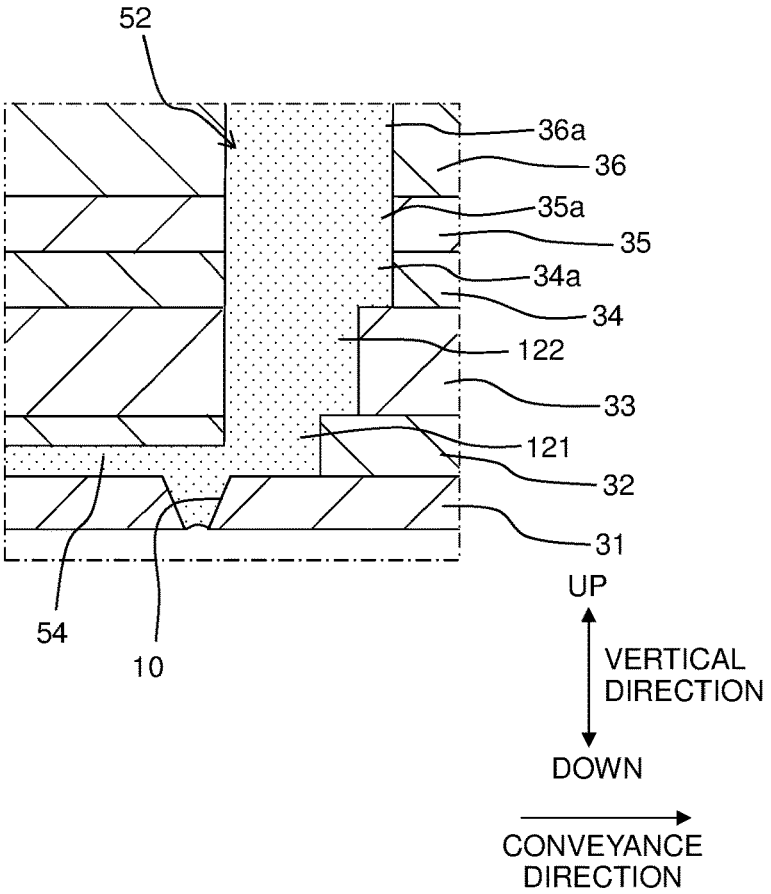
FIG. 8B depicts a fourth modification and corresponds to FIG. 4B of the embodiment of the present disclosure.

For example, the above embodiment may be changed in a fourth modification, as follows. In the fourth modification, as depicted in FIG. 8B, the position in the conveyance direction of an end at the second side in the conveyance direction of a through hole 121 of the plate 32 and the position in the conveyance direction of an end at the second side in the conveyance direction of a through hole 122 of the plate 33 do not vary depending on the position in the vertical direction. The end at the second side in the conveyance direction of the through hole 122 is positioned at the first side in the conveyance direction with respect to an end at the second side in the conveyance direction of the through holes 34*a* to 38*a*. The end at the second side in the conveyance direction of the through hole 121 is positioned at the first side in the conveyance direction with respect to the end at the second side in the conveyance direction of the through hole 122. Thus, also in the fourth modification, the end at the second side in the conveyance direction of the lower end of the descender 52 is formed in a step-like shape in which a lower portion (a portion closer to the nozzle 10 in the vertical direction) thereof is positioned at the first side in the conveyance direction with respect to an upper portion thereof.

In the above embodiment, the entirety of the channel connecting the lower end of the descender 52 and the second common channel 43 is the second throttle channel 54. The present disclosure, however, is not limited thereto. For example, the following configuration is may be adopted. A channel ("the second connecting channel" of the present disclosure) extending in the conveyance direction to connect the descender 52 and the second common channel 43 is provided. A part of the channel (the second connecting channel) that includes a portion overlapping in the vertical direction with the nozzle 10 and is positioned at the descender 52 side is defined as a descender side channel The descender side channel is formed over an entirety in the vertical direction of the plate 32, and a part of the channel (the second connecting channel) positioned at the second common channel 43 side with respect to the descender side channel is defined as the second throttle channel formed in the lower portion of the plate 32.

In this configuration, the descender side channel overlaps in the vertical direction with the nozzle 10. Since the descender side channel is formed over the entirety in the vertical direction of the plate 32, the length in the vertical direction of the descender side channel is long. That is, the length in the vertical direction of the part included in the channel (the second connecting channel) connecting the descender 52 and the second common channel 43 and overlapping in the vertical direction with the nozzle 10 in this configuration is longer than that in the above embodiment. Thus, when ink is discharged from the nozzle 10 by applying pressure to ink in the pressure chamber 51 using the piezoelectric actuator 22, ink is easily supplied from the descender 52 to the nozzle 10.

In the above embodiment, when ink circulates between the ink tank 59 and the head unit 6, ink flows from the first throttle channel 53 to the individual channel 41, and ink in the individual channel 41 flows out from the second throttle channel 54. The present disclosure, however, is not limited thereto. The flowing of ink when ink circulates between the ink tank 59 and the head unit 6 of the above embodiment may be reversed by reversing the direction in which ink is fed by the pumps 58*a* and 58*b* of the above embodiment.

In the above embodiment, the first common channel 42 overlaps in the vertical direction with the second common channel 43. The present disclosure, however, is not limited thereto. The positional relationship between the first common channel 42 and the second common channel 43 may be different from the above embodiment (e.g., the first common channel 42 and the second common channel 43 may be arranged in the conveyance direction).

In the above embodiment and modifications, the step(s) is/are provided in the end at the second side in the conveyance direction of the lower end of the descender 52. The present disclosure, however, is not limited thereto. For example, the end at the second side in the conveyance direction of the lower end of the descender 52 may be a curved surface or an inclined surface in which a lower portion thereof (a portion closer to the nozzle 10) is positioned at the first side in the conveyance direction (the second throttle channel 54 side) with respect to an upper portion thereof.

Further, in the above embodiment and modifications, the channel unit 21 is formed by stacking the plates 31 to 39 in the vertical direction. The present disclosure, however, is not limited thereto. The channel unit may be formed by any other members than the plates stacked in the vertical direction.

The above explanation is related to the examples in which the present disclosure is applied to the ink-jet head that discharges ink from the nozzles. The present disclosure, however, is not limited thereto. The present disclosure can be applied to any other liquid discharge head, than the ink-jet head, that discharges any other liquid than ink.

What is claimed is:

1. A liquid discharge head, comprising a channel unit including an individual channel, a first common channel, and a second common channel, wherein the first common channel and the second common channel are connected to the individual channel, wherein the individual channel includes:

a nozzle;

a pressure chamber disposed apart from the nozzle in a first direction;

a descender forming at least a part of a channel that connects the nozzle and the pressure chamber, positioned between the nozzle and the pressure chamber in the first direction, and extending in the first direction, wherein one end of the descender in the first direction is nearer to the nozzle than the other end of the descender;

a first connecting channel connecting the pressure chamber and the first common channel; and a second connecting channel positioned between the second common channel and the descender in a second direction orthogonal to the first direction, and connecting the second common channel and the one end of the descender, a central axis of the nozzle is positioned between the second common channel and a central axis of the descender in the second direction, the descender includes a first portion including the one end, and a second portion positioned between the pressure chamber and the first portion in the first direction, and in an end, of the descender, opposite to the second connecting channel in the second direction, an inner wall defining the one end of the first portion protrudes toward the second connecting channel in the second direction beyond an inner wall defining the second portion.

2. The liquid discharge head according to claim 1, wherein the channel unit includes a plurality of plates stacked in the first direction, the plates include:

a nozzle plate including the nozzle, a pressure chamber plate including the pressure chamber, at least one first descender plate including the first portion of the descender, wherein the at least one first descender plate includes a nozzle-side plate disposed on the nozzle plate, and at least one second descender plate including the second portion of the descender.

3. The liquid discharge head according to claim 2, wherein the at least one second descender plate includes a plurality of second descender plates stacked in the first direction.

4. The liquid discharge head according to claim 2, wherein in the end of the descender in the second direction, the inner wall defining the one end of the first portion of the descender has a staircase structure approaching the nozzle in the first and second directions.

5. The liquid discharge head according to claim 4, wherein the at least one first descender plate includes a plurality of first descender plates stacked in the first direction.

6. The liquid discharge head according to claim 2, wherein the nozzle-side plate has a through hole forming the first portion of the descender, the through hole of the nozzle-side plate has:

the one end and a pressure-chamber-side portion positioned between the pressure chamber plate and the one end in the first direction, and in an end, of the through hole in the nozzle-side-plate, opposite to the second connecting channel in the second direction, the inner wall defining the one end protrudes toward the second connecting channel in the second direction beyond an inner wall defining the pressure-chamber-side portion.

7. The liquid discharge head according to claim 6, wherein in the end of the through hole in the nozzle-side plate, an inner wall defining the through hole of the nozzle-side plate has a step or level difference between the one end and the pressure-chamber-side portion.

8. The liquid discharge head according to claim 2, wherein the second connecting channel is defined by a recess located in a surface of the nozzle-side plate facing the nozzle plate and a surface of the nozzle plate covering the recess.

9. The liquid discharge head according to claim 1, wherein the following relational expression is satisfied:

$$W3<W1<W2$$

in the above relational expression, W1, W2, and W3 are as follows:

W1: a maximum length in the second direction of the one end of the descender W2: a maximum length in the second direction of the second portion of the descender W3: a maximum length in the first direction of a connecting portion of the second connecting channel with the descender.

10. The liquid discharge head according to claim 1, wherein in the end of the descender in the second direction, the inner wall defining the one end of the first portion of the descender has a curved surface or an inclined surface which approach the nozzle in the first and second directions.

11. The liquid discharge head according to claim 1, wherein one end, of the first portion of the descender, opposite to the second connecting channel in the second direction is positioned on a reference ellipse or positioned further away from the second connecting channel in the second direction than the reference ellipse, a center of the reference ellipse is located at the other end, of the first portion of the descender, in the second direction and at a boundary end, of the first portion of the descender, wherein the boundary end is a boundary between the first portion and the second portion in the first direction, the reference ellipse has a first axis extending in the first direction and a second axis extending in the second direction, and a length of the first axis is twice a length in the first direction of the first portion of the descender, and a length of the second axis is twice a maximum length in the second direction of the second portion of the descender.

12. The liquid discharge head according to claim 11, wherein in the one end of the first portion of the descender in the second direction, an inner wall defining the first portion of the descender has:

a first surface extending in the first direction, including a first end and a second end that is located further away from the pressure chamber than the first end in the first direction, and a second surface connected to the first end of the first surface, and extending from the first end to an opposite side to the second connecting channel in the second direction, and a corner connecting the first surface and the second surface is positioned on the reference ellipse.

13. The liquid discharge head according to claim 11, wherein the maximum length in the second direction of the second portion of the descender is equal to the length in the first direction of the first portion of the descender.

14. The liquid discharge head according to claim 11, wherein the reference ellipse is a circle in which the length of the first axis is equal to the length of the second axis.

15. The liquid discharge head according to claim 1, wherein a third direction is orthogonal to the first direction and the second direction, both ends, in the third direction, of a connecting portion of the second connecting channel with the descender are positioned between both ends, in the third direction, of the first portion of the descender, and the both ends, in the third direction, of the first portion of the descender are positioned between both ends, in the third direction, of the second portion of the descender.

16. The liquid discharge head according to claim 15, wherein the inner wall defining the one end of the descender has a protruding wall that protrudes, in the second direction and the third direction, toward an inside of the descender beyond the inner wall defining the second portion of the descender, the protruding wall has an arc-like surface that is convex toward an outside of the descender when seen from the first direction, and both ends in a circumferential direction of the arc-like surface are connected to an inner wall defining the second connecting channel.

17. The liquid discharge head according to claim 1, wherein an inner wall of the descender at a side near to the second connecting channel in the second direction forms a straight line extending in the first direction, when seen from a third direction orthogonal to the first direction and the second direction.

* * * * *